United States Patent [19]

Müller et al.

[11] 4,186,056

[45] Jan. 29, 1980

[54] DEVICE FOR CLOSING THE FILLING OPENING OF A COKE OVEN CHAMBER

[75] Inventors: Hans-Hermann Müller; Johannes Wulfmeier, both of Essen, Fed. Rep. of Germany

[73] Assignee: Didier Engineering GmbH, Essen, Fed. Rep. of Germany

[21] Appl. No.: 923,405

[22] Filed: Jul. 10, 1978

[30] Foreign Application Priority Data

Jul. 16, 1977 [DE] Fed. Rep. of Germany ..... 2732245

[51] Int. Cl.[2] ..... C10B 25/20

[52] U.S. Cl. ..... 202/250; 49/485; 202/269

[58] Field of Search ..... 202/242, 244, 250, 251, 202/269, 248; 49/485

[56] References Cited

U.S. PATENT DOCUMENTS

| | | | |
|---|---|---|---|
| 976,931 | 11/1910 | Schniewind | 202/250 |
| 1,461,324 | 7/1923 | Puening | 202/250 |
| 1,995,939 | 3/1935 | Osten | 49/485 X |
| 2,920,017 | 1/1960 | Limberg | 202/242 X |

FOREIGN PATENT DOCUMENTS

| | | | |
|---|---|---|---|
| 750980 | 6/1944 | Fed. Rep. of Germany | 202/250 |
| 318756 | 10/1902 | France | 202/250 |
| 331981 | 7/1930 | United Kingdom | 49/485 |

*Primary Examiner*—Arnold Turk

*Attorney, Agent, or Firm*—Wenderoth, Lind & Ponack

[57] ABSTRACT

Frame has an opening therethrough and is positioned on a coke oven chamber ceiling with the opening of the frame aligned with a filling opening of the coke oven chamber ceiling. The frame has formed therein a recessed duct which surrounds the opening. A filling cover, adapted to close the opening, has extending therefrom a substantially annular projection. The duct in the frame has filled therein a displaceable material which is capable of being displaced by the projection, for example a pulverulent material. When the cover is positioned over the frame, the projection extends into and partially displaces the displaceable material, thereby sealing the cover with respect to the frame and closing the filling opening.

8 Claims, 1 Drawing Figure

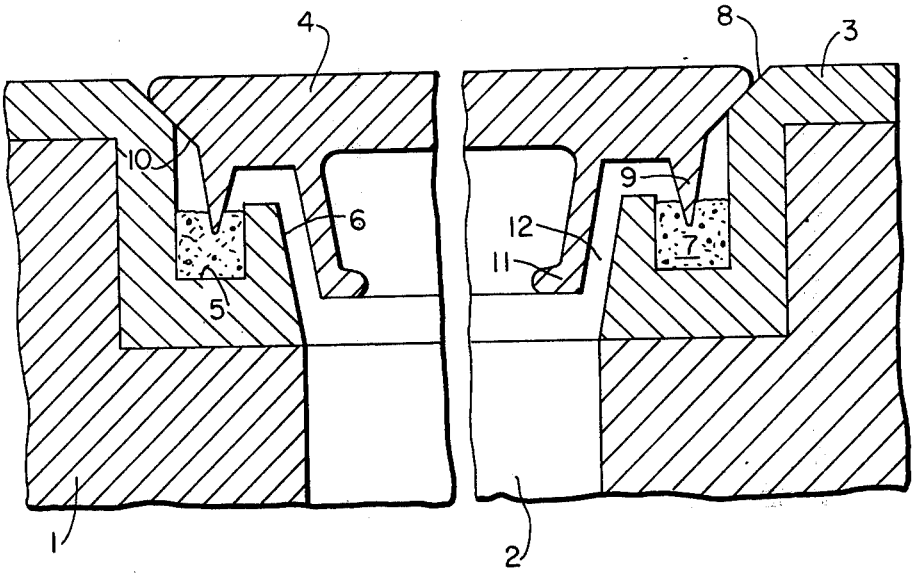
4
8
3
10
9
6
12
7
11
5
1
2

DEVICE FOR CLOSING THE FILLING OPENING OF A COKE OVEN CHAMBER

BACKGROUND OF THE INVENTION

The present invention relates to a closing device for closing a filling opening of a coke oven chamber. More particularly, the present invention relates to such a closing device of the type including a frame positioned on the coke oven and a cover adapted to be inserted into the frame.

It is known to close the filling openings of coke oven chambers by closing devices including a frame fitting on the coke oven chamber ceiling such that an opening through the frame aligns with the filling opening of the coke oven chamber ceiling, and a filling cover adapted to be inserted into the frame to close the opening, the frame and cover having complementary sealing surfaces which operate to close and seal the filling opening. However, during the normal use of a coke oven chamber, such known frames and covers are exposed to very high thermal loads. This causes differential expansion between the frame and the cover, such that it is not possible to attain sufficient sealing tightness of the cover during the entire coking phase or operation of the coke oven chamber. Tar-containing crude gases will escape at positions of leaks between the sealing surfaces of the frame and the cover. Such gases are condensed during the cooling which takes place during discharge of the coke oven chamber, and the resultant solid residues become deposited on the sealing surfaces of the cover and frame, thereby further preventing the achievement of a tight seal. Such residues can be removed only with very great difficulty.

SUMMARY OF THE INVENTION

With the above discussion in mind, it is the primary object of the present invention to provide an improved closing device for closing a filling opening extending through the ceiling of a coke oven chamber.

It is a more specific object of the present invention to provide such an improved closing device which ensures sufficient tightness of the closing of the filling opening, even at very high temperatures.

It is a further object of the present invention to provide such an improved closing device which can easily and inexpensively be maintained in optimum working order.

The above objects are achieved in accordance with the present invention by the provision of a frame having an opening therethrough, the frame being adapted to be positioned on a coke oven chamber ceiling with the opening of the frame aligned with the filling opening of the coke oven chamber ceiling. The frame has formed therein a recessed duct which surrounds the opening. There is provided a filling opening cover adapted to be inserted into the frame to close the opening. The cover has extending therefrom a substantially annular projection. The duct is substantially filled with a displaceable material which is capable of being displaced by the projection. When the cover is positioned over the frame to close the opening, the projection extends into and somewhat displaces the displaceable material. Thus, the immersion of the projection of the cover into the displaceable material results in the material sealing the cover with respect to the frame. No thermal stresses which would result in leakage occur, since the displaceable material readily allows differential thermal expansion and displacement of the frame and the cover.

Although the duct and the projection are normally annular and circular in configuration, other configurations are possible and intended to be within the scope of the present invention.

The displaceable material preferably is a pulverulent material which is loose and has heat resistant properties, at least to the temperatures to which the material would be subjected during the operation of the coke oven chamber. Such pulverulent material may be at least one material selected from the group consisting of sand, graphite powder and asbestos powder, or any other similar pulverulent and heat resistant loose material. It is of advantage that the pulverulent material provides a reliable seal, even when the cover is positioned such that it is not entirely level with respect to the frame. It is further advantageous that the material be such that the projection extends into and partially displaces the material due to the deadweight of the cover alone.

The maintenance of the displaceable material is very easy and inexpensive. Specifically, when the displaceable material becomes soiled, it may be readily replaced merely by removing the soiled material from the duct and then again filling the duct with fresh material.

Additionally, it is to be understood to be within the scope of the present invention that the displaceable material may be a viscous liquid or plastic material.

In accordance with a further feature of the present invention, the frame and cover may be provided with complementary sealing surfaces which are adapted to be in abutting contact when the projection extends into and partially displaces the displaceable material. This prevents the passage or entry into the displaceable material of soot or coal particles which would soil the displaceable material.

In accordance with a preferred embodiment of the invention, the projection has a cross-section which tapers substantially to a point, thereby facilitating the immersion or extension of the projection into the displaceable material. However, the projection could have other configurations. Furthermore, the cover and the projection are preferably integrally formed from a single member. However, the projection could alternatively be formed of a separate member which is then attached, for example by bolting, to the cover.

According to a further preferred feature of the present invention, the cover is provided with a plug which extends into the opening in the frame and which is spaced from a wall of the frame which defines the opening therethrough and which is positioned radially inwardly from the duct by a gap which is in communication with the displaceable material in the duct. The area of the filling opening adjacent such gap contains only a small amount of crude gas, and the temperature in such area adjacent the gap only rarely drops below the condensation temperature of the tarry components of the crude gas.

Therefore, there will at most be only a slight condensation of solid residues in such area. By thus providing the gap which communicates with the displaceable material in the duct, it is thereby possible to substantially avoid the buildup of and solid residues which would prevent the intended operation of the closing device of the present invention.

BRIEF DESCRIPTION OF THE DRAWING

Other objects, features and advantages of the present invention will be apparent from the following detailed description, taken with the accompanying single drawing FIGURE which is a cross-sectional view through a portion of a coke oven chamber ceiling equipped with a closing device in accordance with the present invention.

DETAILED DESCRIPTION OF THE INVENTION

With reference now to the drawing, there is partially shown therein a coke oven chamber ceiling 1 having therein a filling opening 2. A frame 3 is adapted to fit within a recess within the coke oven chamber ceiling 1, such that an opening through the frame 3 aligns with the filling opening 2.

However, in accordance with the present invention, frame 3 is provided with a recessed duct 5 at a position radially outwardly of the opening through the frame and surrounding such opening. A filling cover 4 is provided with a substantially annular projection 9. Duct 5 is substantially filled with a displaceable material 7 which is capable of being displaced by projection 9. Accordingly, when the cover 4 is positioned over the frame 3 to close the filling opening, projection 9 extends into and at least partially displaces the displaceable material 7. Preferably, the displaceable material 7 is such that the projection 9 extends thereinto due to the deadweight of the cover 4 alone. There is thereby created a seal, and specifically the displaceable material 7 seals the cover with respect to the frame, thereby closing the filling opening.

The most conventional and generally desirable configuration of duct 5 and projection 9 is circular. However, duct 5 and projection 9 could have other configurations, for example oval or polygonal. As employed herein with respect to the configurations of duct 5 and projection 9, the term "annular" is not intended to be limited solely to a circular configuration, but rather is intended to refer to any enclosed configuration which would be obvious to those skilled in the art and which for example might be necessitated by the configuration of filling opening 2.

In a preferred embodiment of the present invention the displaceable material is a pulverulent material which has heat resistant properties such that the material is resistant to temperatures to which it would be subjected during the normal operation of the coke oven chamber and which would still be capable of being displaced by the projection 9 at such normal operating temperatures. Examples of such pulverulent material are sand, graphite powder and asbestos powder. It is however to be understood that the displaceable material 7 may comprise any other similar pulverulent and heat resistant loose material having the above discussed properties. Additionally however, it is to be understood to be within the scope of the present invention that displaceable material 7 could also include a viscous liquid or plastic material having the above discussed properties.

As shown in the drawing, the projection has a cross-sectional configuration that tapers substantially to a point. However, it is intended to be within the scope of the present invention that the projection may have other cross-sectional configurations which allow the projection to extend into and partially displace the displaceable material 7. Furthermore, in accordance with a preferred embodiment of the present invention, and as illustrated in the FIGURE, the cover and the projection are integrally formed from a single member, for example a single casting. However, it is intended to be within the scope of the present invention that projection 9 may be separately formed and then attached, for example by bolting, to cover 4. The length of projection 9 is such that it can be immersed or extended into displaceable material 7 by a sufficient depth to ensure the desired seal between the cover and the frame. For example, projection 9 should have a length such that it might extend for a portion of its length only to a depth of up to approximately one-half of the depth of the displaceable material 7. Furthermore, displaceable material 7 should be a material such that a satisfactory seal is achieved even when cover 4 is positioned such that it is not entirely level with frame 3.

In accordance with a further feature of the present invention, frame 3 and cover 4 are provided with complementary sealing surfaces 8 and 10, respectively. Surface 10 is in abutting contact with surface 8 only when projection 9 is immersed or extended into displaceable material 7 by a depth sufficient to achieve the desired seal. When sealing surfaces 8 and 10 are in contact, they do not in any way cause stresses upon relative thermal expansion of frame 3 and cover 4. The provision of abutting surfaces 8 and 10 prevents the entry of soot, coal particles or other particles from above which would otherwise soil displaceable material 7.

The opening through frame 3 is defined by a wall 6 which is positioned radially inwardly of duct 5. Cover 4 may be provided with a plug 11 which extends into the opening through the frame. Plug 11 is inwardly spaced from wall 6 to define therebetween a gap 12 which is in communication with the displaceable material 7 in duct 5. When the coke oven chamber is in operation, the temperature in gap 12 leading from filling opening 2 to the surface of displaceable material 7 is normally greater than the condensation temperature of any tarry components of the crude gas present. Accordingly, there will not be any substantial quantity of solid residue formed in the area of gap 12. Gap 12 is of course of a dimension such as to accommodate any residues which are formed. Accordingly, the position of cover 4 with respect to frame 3 is at all times dependent only upon the immersion of projection 9 into displaceable material 7. This ensures that under no circumstances will a leak occur.

When cover 4 is inserted into frame 3, projection 9, under the deadweight of the cover, is forced into displaceable material 7 and displaces it accordingly. Due to the pressure exerted during such displacement, a certain degree of compression of material 7 occurs. Any crude gas present in filling opening 2 is thereby effectively prevented from escaping through displaceable material 7. Contact between surfaces 8 and 10 prevents soiling of the material 7. The seal provided by displaceable material 7 is effective even when the cover is positioned such that it is not entirely level with the frame. Furthermore, even during differential expansion of the cover 4 and the frame 3, such that the relative position of projection 9 within the material 7 is changed, a completely effective seal will still be maintained. Duct 5 is provided with a width which is sufficient to absorb any such differential expansion.

When material 7 becomes soiled and must be replaced, such replacement may be easily undertaken merely by removing the soiled material 7 and replacing it with fresh material. The material 7 may be protected against contamination during the filling of the oven chamber with coal, i.e. when the cover 4 is removed, by providing suitable covering devices on the funnel or funnels of the filling equipment.

Although the present invention has been illustrated and described with respect to preferred features thereof, it is to be understood that various modifications of the features illustrated and described may be made without departing from the scope of the present invention.

What we claim is:

1. A closing device for closing a filling opening extending through the ceiling of a coke oven chamber, said closing device comprising:

a frame having an opening therethrough, said frame adapted to be positioned on a coke oven chamber ceiling with said opening of said frame aligned with a filling opening of the coke oven chamber ceiling, said frame having formed therein a recessed duct surrounding said opening;

a filling opening cover adapted to close said opening, said cover having extending therefrom a substantially annular projection;

said duct having therein a displaceable pulverulent material which is capable of being displaced by said projection;

such that when said cover is positioned over said frame, said projection extends into said displaceable pulverulent material, thereby forming a first seal closing said filling opening; and said frame having a first inclined sealing surface positioned radially outwardly of said duct, said cover having a second inclined sealing surface positioned radially outwardly of said projection, said first and second inclined sealing surfaces inclining downwardly and inwardly towards the center of the frame opening and being in mutually abutting contact when said projection extends into and displaces said displaceable pulverulent material, thereby forming a second seal which surrounds said first seal and which prevents debris from passing between said cover and said frame into said duct.

2. A device as claimed in claim 1, wherein said recess and said projection extend substantially circularly.

3. A device as claimed in claim 1, wherein said pulverulent material is at least one material selected from the group consisting of sand, graphite powder and asbestos powder.

4. A device as claimed in claim 1, wherein said projection extends into and displaces said displaceable material due to the deadweight of said cover.

5. A device as claimed in claim 1, wherein said projection has a cross-section that substantially tapers to a point.

6. A device as claimed in claim 1, wherein said cover and said projection are integrally formed from a single member.

7. A device as claimed in claim 1, wherein said opening through said frame is defined by a wall which is positioned radially inwardly of said duct, wherein said cover has a plug that extends into said opening when said cover is positioned over said frame, with said plug being spaced from said wall by an annular gap.

8. A device as claimed in claim 7, wherein said gap is in communication with said displaceable material in said duct.

* * * * *